US009599100B2

(12) United States Patent
Nose et al.

(10) Patent No.: US 9,599,100 B2
(45) Date of Patent: Mar. 21, 2017

(54) ELECTRIC-POWERED PUMP

(71) Applicant: Mitsubishi Electric Corporation, Chiyoda-ku, Tokyo (JP)

(72) Inventors: Shinya Nose, Tokyo (JP); Hidehiro Soga, Tokyo (JP); Masayuki Aota, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 302 days.

(21) Appl. No.: 14/491,193

(22) Filed: Sep. 19, 2014

(65) Prior Publication Data

US 2015/0308422 A1 Oct. 29, 2015

(30) Foreign Application Priority Data

Apr. 28, 2014 (JP) ..... 2014-092682

(51) Int. Cl.

| | |
|---|---|
| ***F04B 1/18*** | (2006.01) |
| ***F04B 1/14*** | (2006.01) |
| ***F04B 53/10*** | (2006.01) |
| *F04B 7/02* | (2006.01) |

(52) U.S. Cl.

CPC ..... *F04B 1/18* (2013.01); *F04B 1/141* (2013.01); *F04B 1/143* (2013.01); *F04B 1/146* (2013.01); *F04B 53/1037* (2013.01); *F04B 7/02* (2013.01)

(58) Field of Classification Search

CPC ..... F04B 1/0448; F04B 1/0465; F04B 1/08; F04B 1/107; F04B 1/141; F04B 1/143; F04B 1/146; F04B 1/18; F04B 1/188; F04B 7/0073; F04B 7/02; F04B 53/1037; F04B 1/28; F04B 1/29; F04B 1/295; F04B 49/02; F04B 49/03; F04B 49/035

USPC ..... 417/283

See application file for complete search history.

(56) References Cited

U.S. PATENT DOCUMENTS

| | | | | |
|---|---|---|---|---|
| 2,501,054 A * | 3/1950 | Huber | F04B 1/143 | 137/115.18 |
| 2,797,647 A * | 7/1957 | Floraday | F04B 1/124 | 417/269 |
| 3,679,328 A * | 7/1972 | Cattanach | F04B 1/145 | 417/270 |
| 3,754,842 A * | 8/1973 | Schlanzky | F04B 1/18 | 417/269 |

(Continued)

FOREIGN PATENT DOCUMENTS

JP 4650851 B2 3/2011

*Primary Examiner* — Devon Kramer
*Assistant Examiner* — Joseph Herrmann
(74) *Attorney, Agent, or Firm* — Sughrue Mion, PLLC; Richard C. Turner

(57) ABSTRACT

A movable body that has a cylinder and a valve apparatus is accommodated inside an accommodating chamber of a pump body so as to cover a discharging orifice. A piston sucks a fluid into the movable body, and discharges the fluid from inside the movable body to the discharging orifice by being slid reciprocally through a piston sliding aperture of the cylinder. A relieving passage that communicates between a suction volume space of the accommodating chamber and the discharging orifice is formed between an inner surface of the accommodating chamber and the movable body by the movable body moving away from the discharging orifice in opposition to a force from a forcing body.

5 Claims, 12 Drawing Sheets

(56) References Cited

U.S. PATENT DOCUMENTS

| | | | | |
|---|---|---|---|---|
| 4,576,554 | A * | 3/1986 | Wagenseil | F04B 1/141<br>417/270 |
| 7,887,302 | B2 * | 2/2011 | Hutto, Jr. | F04B 1/143<br>417/213 |

* cited by examiner

ELECTRIC-POWERED PUMP

BACKGROUND OF THE INVENTION

1. Field of the Invention

The present invention relates to an electric-powered pump that performs suction and discharging of a fluid by a driving force from a motor portion.

2. Description of the Related Art

In recent years, as fuel economy of automobiles, etc., has improved and exhaust emissions regulations have tightened, adoption of idling reduction systems has advanced as a technique that that can be expected to be highly effective in improving fuel economy and reducing emissions comparatively simply and conveniently. Idling reduction systems are systems that stop an engine during temporary stopping or during low-speed movement of an automobile and restart the engine when starting to move again. Electric-powered pumps have been used in idling reduction systems in order to generate pressure inside a transmission or to fill the transmission with oil during idling reduction in order to reduce departure shock immediately after the engine is restarted, for example. If there is a greater oil discharge flow rate from the electric-powered pump than the flow rate required on the transmission side, or changes in transmission volume arise rapidly, then oil discharging pressure in the electric-powered pump may increase temporarily.

Fuel supplying apparatuses are conventionally known in which fuel is discharged and supplied to an injector by disposing a pressure chamber in a cylinder block, and reciprocally sliding a piston inside the pressure chamber using a driving force from a motor. In the conventional fuel supplying apparatuses, a fuel pressure adjusting apparatus that adjusts fuel discharging pressure by releasing the pressure from a fuel discharging passage to an intake side when fuel discharging pressure becomes high is disposed on the cylinder block (see Patent Literature 1, for example).

CITATION LIST

Patent Literature

[Patent Literature 1]
Japanese Patent No. 4650851 (Gazette)

SUMMARY OF THE INVENTION

However, in conventional fuel supplying apparatuses, because it is necessary to secure space for installing the fuel pressure adjusting apparatus inside the cylinder block, the cylinder block is increased in size, increasing the entire fuel supplying apparatus in size. Furthermore, because the fuel pressure adjusting apparatus is installed inside the cylinder block separately, the number of parts in the fuel pressure adjusting apparatus is also increased, not only preventing cost reductions, but also making manufacturing of the fuel supplying apparatus and the fuel pressure adjusting apparatus time-consuming.

The present invention aims to solve the above problems and an object of the present invention is to provide an electric-powered pump that can be easily manufactured, and that enables size reductions and cost reductions to be achieved.

In order to achieve the above object, according to one aspect of the present invention, there is provided an electric-powered pump including: a motor portion; and a pump portion that is operated by a driving force from the motor portion, wherein: the pump portion includes: a pump body in which an accommodating chamber is disposed, a suction orifice and a discharging orifice being formed on an inner surface of the accommodating chamber; a movable body that includes: a cylinder through which a piston sliding aperture passes; and a valve apparatus that is disposed on the cylinder, the movable body being accommodated inside the accommodating chamber so as to cover the discharging orifice such that the valve apparatus is disposed between the cylinder and the discharging orifice, and the movable body being movable inside the accommodating chamber away from the discharging orifice parallel to a direction of passage of the piston sliding aperture in the cylinder; a piston that is inserted into the piston sliding aperture, and that sucks a fluid into the movable body through a suction aperture that passes through the cylinder and discharges the fluid from inside the movable body to the discharging orifice by being slid reciprocally through the piston sliding aperture by the driving force from the motor portion; and a forcing body that is disposed in a suction volume space that is a portion of a space inside the accommodating chamber that is on a side of the movable body that is near the suction orifice, the forcing body forcing the movable body in a direction in which the movable body covers the discharging orifice; the valve apparatus allows flow of the fluid from the suction aperture to the discharging orifice, and also stops reverse flow of the fluid from the discharging orifice to the suction aperture; and a relieving passage that communicates between the suction volume space and the discharging orifice is formed between an inner surface of the accommodating chamber and the movable body by the movable body moving away from the discharging orifice in opposition to the force from the forcing body.

An electric-powered pump according to the present invention can be easily manufactured, and reductions in size and cost can be achieved.

DETAILED DESCRIPTION OF THE PREFERRED EMBODIMENTS

Preferred embodiments of the present invention will now be explained with reference to the drawings.

Embodiment 1

Figure 1:
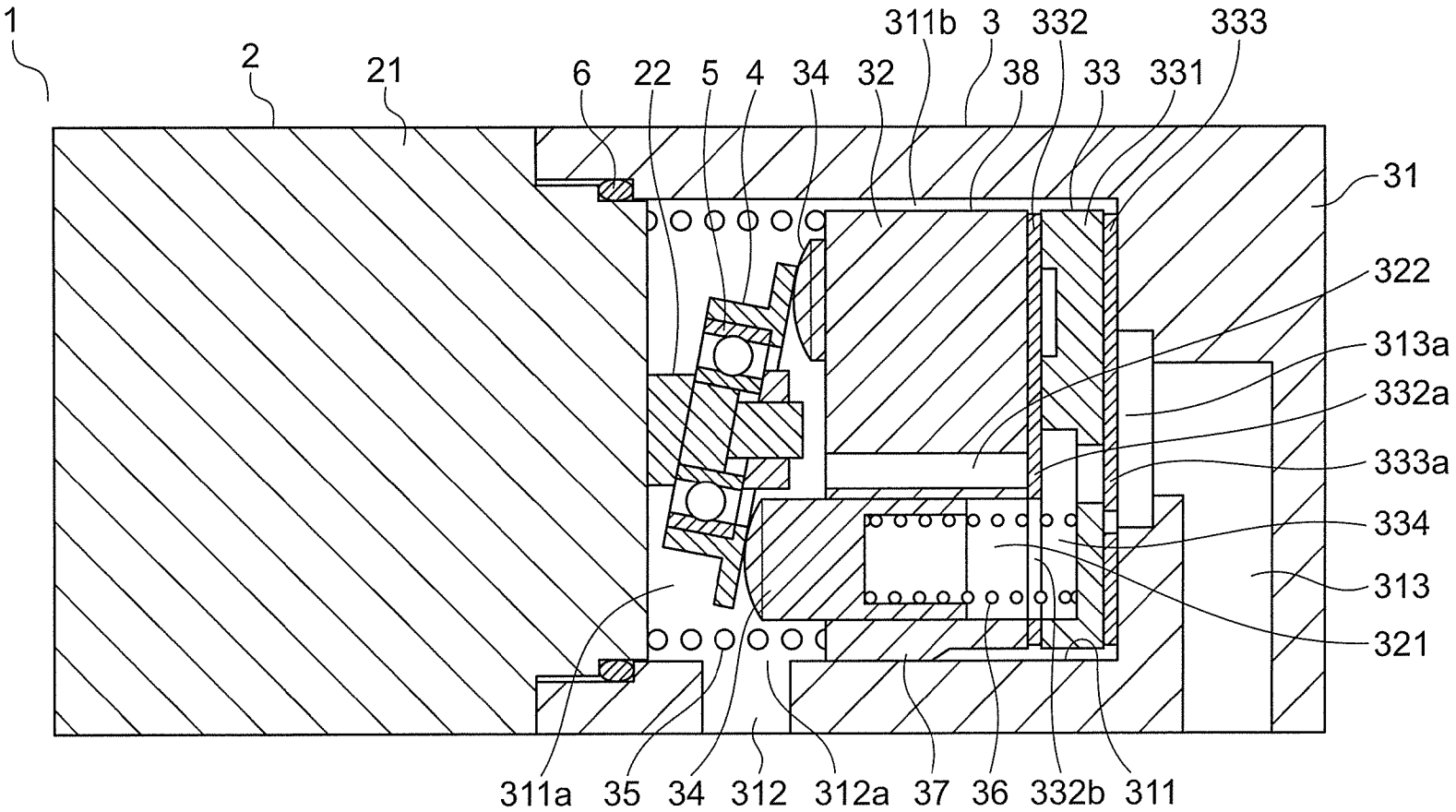
FIG. 1 is a cross section that shows an electric-powered pump according to Embodiment 1 of the present invention.

FIG. 1 is a cross section that shows an electric-powered pump according to Embodiment 1 of the present invention. In the figure, an electric-powered pump 1 has: a motor portion 2; a pump portion 3 that is disposed on the motor portion 2, and that is operated by a driving force from the motor portion 2; and a driver portion (not shown) that is mounted onto the motor portion 2, and that controls the motor portion 2. In this example, the electric-powered pump 1 is an automotive electric-powered oil pump that is mounted to a vehicle such as an automobile. Furthermore, in this example, the electric-powered pump is used in an idling reduction system as an oil pump that fills a transmission with oil (a hydraulic pump that generates pressure inside the transmission) during idling reduction in order to reduce departure shock immediately after an engine is restarted.

The motor portion 2 has: a motor portion main body 21; and a rotating shaft 22 that protrudes from the motor portion main body 21 into the pump portion 3. The motor portion main body 21 has: a stator that includes a stator coil; and a rotor that is rotatable relative to the stator around an axis of the motor portion 2. The stator generates a rotating magnetic field when an electric current is passed to the stator coil from the driver portion. The rotor is rotated relative to the stator by the rotating magnetic field that is generated by the stator. In this example, the rotor has permanent magnets, and the motor portion 2 is a brushless motor.

The rotating shaft 22 is disposed on the axis of the motor portion 2. The rotating shaft 22 is rotated around the axis of the motor portion 2 together with the rotor of the motor portion main body 21. A swash plate 4 is rotatably mounted onto an end portion of the rotating shaft 22 near the pump portion 3 by means of a bearing 5. The swash plate 4 is mounted onto the rotating shaft 22 such that a flat surface portion is inclined relative to the axis of the rotating shaft 22. The inclination of the flat surface portion of the swash plate 4 relative to the motor portion main body 21 thereby changes in response to the rotation of the rotating shaft 22.

The pump portion 3 has: a pump body 31 on which is disposed an accommodating chamber (a recess portion) 311 that has an open portion; a movable body 38 that is disposed inside the accommodating chamber 311; a plurality of (in this example, three) pistons 34 that are slidable relative to the movable body 38; and a forcing spring 35 that forces the movable body 38.

The pump body 31 is fitted onto a housing of the motor portion main body 21 such that the open portion of the accommodating chamber 311 is covered by the motor portion main body 21. The rotating shaft 22 protrudes into the accommodating chamber 311 from the motor portion main body 21. The pump body 31 is mounted onto the housing of the motor portion main body 21 such that a depth direction of the accommodating chamber 311 is oriented in an axial direction of the rotating shaft 22. A sealing member 6 is interposed at a boundary between the pump body 31 and the motor portion main body 21. Leaking of the oil (the fluid) from between the motor portion 2 and the pump portion 3 is prevented by the sealing member 6.

A suction passage 312 and a discharging passage 313 that both communicate with an exterior of the pump body 31 and an interior of the accommodating chamber 311 are disposed on the pump body 31. A suction orifice 312*a* with which the suction passage 312 communicates, and a discharging orifice 313*a* with which the discharging passage 313 communicates, are formed on an inner surface of the accommodating chamber 311 of the pump body 31. The suction orifice 312*a* is formed on a side surface of the inner surface of the accommodating chamber 311 that is parallel to the depth direction of the accommodating chamber 311. The discharging orifice 313*a* is formed on a bottom surface of the inner surface of the accommodating chamber 311 that is perpendicular to the depth direction of the accommodating chamber 311. The discharging orifice 313*a* is thereby at a position that is further away from the motor portion 2 than the suction orifice 312*a*.

The movable body 38 is accommodated inside the accommodating chamber 311 so as to cover the discharging orifice 313*a* while contacting the bottom surface of the accommodating chamber 311. The movable body 38 is disposed at a position that is further away from the motor portion 2 than the suction orifice 312*a*. In addition, the movable body 38 is movable parallel to the depth direction of the accommodating chamber 311. The movable body 38 is thereby movable away from the discharging orifice 313*a* (i.e., toward the motor portion 2).

A portion of the space inside the accommodating chamber 311 that is on a side of the movable body 38 near the suction orifice 312*a* (i.e., a side of the movable body 38 near the motor portion 2) constitutes a suction volume space 311*a*. A gap 311*b* that communicates with the suction volume space 311*a* is present between a side surface of the accommodating chamber 311 and an outer circumferential surface of the movable body 38. The gap 311*b* is secured inside the accommodating chamber 311 so as not to be blocked even if the movable body 38 moves inside the accommodating chamber 311.

A relieving passage (a gap) 311*c* (FIG. 4) that communicates between the discharging orifice 313*a* and the suction volume space 311*a* is formed between the bottom surface of the accommodating chamber 311 and the movable body 38 by the movable body 38 moving away from the discharging orifice 313*a*. The discharging orifice 313*a* and the suction volume space 311*a* communicate with each other by means of the gap 311*b* and the relieving passage 311*c* when the relieving passage 311*c* is formed inside the accommodating chamber 311.

The movable body 38 has: a cylinder 32; and a valve apparatus 33 that is disposed on the cylinder 32. The movable body 38 is accommodated inside the accommodating chamber 311 such that the valve apparatus 33 is disposed between the cylinder 32 and the discharging orifice 313*a*. Thus, the valve apparatus 33 is in contact with the bottom surface of the accommodating chamber 311 when the movable body 38 is covering the discharging orifice 313*a* inside the accommodating chamber 311.

The cylinder 32 is a cylindrical block that is disposed such that a height direction is oriented in a depth direction of the accommodating chamber 311. Disposed on the cylinder 32 are: a plurality of (in this example, three) piston sliding apertures (piston chambers) 321 that pass through the cylinder 32 in a depth direction of the accommodating chamber 311 (i.e., the direction that the movable body 38 can move inside the accommodating chamber 311); and a plurality of (in this example, three) suction apertures 322 that pass through the cylinder 32 so as to be parallel to each of the piston sliding apertures 321. The piston sliding apertures 321 are disposed on the cylinder 32 so as to be spaced apart from each other in the circumferential direction of the cylinder 32. In this example, the piston sliding apertures 321 are disposed at a uniform angular pitch on a circle that is centered around the axis of the cylinder 32. Each of the suction apertures 322 is disposed on the cylinder 32 so as to correspond to a piston sliding aperture 321. Moreover, each of the suction apertures 322 may be disposed on the cylinder 32 so as to be inclined relative to the piston sliding apertures 321.

A plurality of (in this example, three) guiding portions 37 that guide the movement of the movable body 38 in the accommodating chamber 311 are disposed on an outer circumferential portion of the cylinder 32 and a side surface of the accommodating chamber 311. In this example, the guiding portions 37 are formed by fitting projections that are disposed on the outer circumferential portion of the cylinder 32 into groove portions that are disposed on the side surface of the accommodating chamber 311. Furthermore, in this example, the guiding portions 37 are disposed on the cylinder 32 so as to be uniformly spaced in a circumferential direction.

The swash plate 4 is disposed in the suction volume space 311*a*. The pistons 34 are inserted into the piston sliding apertures 321 so as to be separately slidable. Piston springs 36 are respectively compressed between each of the pistons 34 and the valve apparatus 33. Each of the pistons 34 is pressed against the flat surface portion of the swash plate 4 by the respective elastic forces of recovery of the piston springs 36. The pistons 34 are slid reciprocally through the piston sliding apertures 321 by the inclination of the flat surface portion of the swash plate 4 changing due to the rotation of the rotating shaft 22. In other words, each of the pistons 34 is slid reciprocally through the piston sliding apertures 321 by the driving force from the motor portion 2. Oil (fluid) that is in the suction volume space 311*a* is sucked into the movable body 38 through each of the suction apertures 322 by the pistons 34 being slid reciprocally through the piston sliding apertures 321, and is discharged from inside the movable body 38 through the discharging orifice 313*a*. The direction in which the pistons 34 are slid reciprocally through the piston sliding apertures 321 is aligned with the direction which the movable body 38 can move inside the accommodating chamber 311.

The valve apparatus 33 has: a valve plate 331 that is disposed between the cylinder 32 and the discharging orifice 313*a*; a flat suction valve 332 that is disposed between the cylinder 32 and the valve plate 331; and a flat discharging valve 333 that is disposed between the valve plate 331 and the discharging orifice 313*a*. Thus, the suction valve 332, the valve plate 331, and the discharging valve 333 are stacked sequentially relative to the cylinder 32 in the valve apparatus 33. Respective outer peripheral shapes of the valve plate 331, the suction valve 332, and the discharging valve 333 are almost identical to an outer peripheral shape of the cylinder 32.

Pressurizing apertures (pressurizing chambers) 334 pass through the valve plate 331. The pressurizing apertures 334 are respectively open toward each of the suction apertures 322 and each of the piston sliding bores 321 of the cylinder 32, and are also open toward the discharging orifice 313*a*.

The suction valve 332 is a flexible member that can be elastically deformed. In the movable body 38, respective seals are formed between the cylinder 32, the suction valve 332, and the valve plate 331 by the suction valve 332 coming into respective surface contact with the cylinder 32 and the valve plate 331.

The suction valve 332 has a plurality of (in this example, three) valve bodies 332*a* that separately open and close opening portions of each of the suction apertures 322 to the pressurizing apertures 334. The opening portions of each of the suction apertures 322 to the pressurizing apertures 334 are opened and closed by elastic deformation of the valve bodies 332*a*. The suction valve 332 opens the opening portions of the suction apertures 322 by the elastic deformation of the valve bodies 332*a* when the pressure in the suction apertures 322 is greater than the pressure in the pressurizing apertures 334, and closes the opening portions of the suction apertures 322 by the elastic deformation of the valve bodies 332*a* when the pressure in the pressurizing apertures 334 is greater than the pressure in the suction apertures 322. The suction valve 332 thereby allows a flow of oil from the suction apertures 322 into the pressurizing apertures 334, and also stops the flow of oil from the pressurizing apertures 334 to the suction apertures 322, by the elastic deformation of the valve bodies 332*a*.

A plurality of (in this example, three) penetrating apertures 332*b* are disposed on the suction valve 332 so as to be aligned with the positions of each of the piston sliding apertures 321. The respective piston sliding apertures 321 and the pressurizing apertures 334 communicate with each other by means of the respective penetrating apertures 332*b* of the suction valve 332. The suction valve 332 thereby allows a flow of oil between the pressurizing apertures 334 and the piston sliding bores 321. The piston springs 36 are compressed between inner surfaces of the pressurizing apertures 334 of the valve plate 331 and inner surfaces of the pistons 34.

The discharging valve 333 is a flexible member that can be elastically deformed. In the movable body 38, a seal is formed between the valve plate 331 and the discharging valve 333 by the discharging valve 333 coming into surface contact with the valve plate 331. A seal is formed between the discharging valve 333 and the bottom surface of the accommodating chamber 311 by the valve apparatus 33 coming into surface contact with the bottom surface of the accommodating chamber 311 when the movable body 38 is covering the discharging orifice 313*a*.

The discharging valve 333 has valve bodies 333*a* that open and close opening portions of the pressurizing apertures 334 to the discharging orifice 313*a*. The opening portions of the pressurizing apertures 334 to the discharging orifice 313*a* are opened and closed by elastic deformation of the valve bodies 333*a*. The discharging valve 333 opens the opening portions of the pressurizing apertures 334 by the elastic deformation of the valve bodies 333*a* when the pressure in the pressurizing apertures 334 is greater than the pressure in the discharging orifice 313*a*, and closes the opening portions of the pressurizing apertures 334 by the elastic deformation of the valve bodies 333*a* when the pressure in the discharging orifice 313*a* is greater than the pressure in the pressurizing apertures 334. The discharging valve 333 thereby allows a flow of oil from the pressurizing apertures 334 into the discharging orifice 313*a*, and also stops the flow of oil from the discharging orifice 313*a* to the pressurizing apertures 334, by the elastic deformation of the valve bodies 333*a*.

The forcing spring 35 is disposed in the suction volume space 311*a* in a compressed state between the cylinder 32 and the motor portion main body 21. The forcing spring 35 thereby generates an elastic force of recovery (a spring force) that forces the movable body 38 in a direction in which the discharging orifice 313*a* is covered. If the pressure in the discharging orifice 313*a* increases and the force from the discharging orifice 313*a* that pushes the movable body 38 becomes greater than the elastic force of recovery of the forcing spring 35, then the movable body 38 moves away from the discharging orifice 313*a* in opposition to the elastic force of recovery of the forcing spring 35. The magnitude of the elastic force of recovery of the forcing spring 35 is set based on allowable pressure in the discharging passage 313.

Next, operation of the electric-powered pump 1 will be explained. When the rotating shaft 22 rotates due to the driving force from the motor portion 2, the swash plate 4 changes the inclination of the flat surface portion while rotating. The pistons 34 are thereby slid reciprocally through the piston sliding apertures 321. In the pump portion 3, a suction operation in which oil is sucked into the movable body 38 through the suction volume space 311*a* from the suction orifice 312*a*, and a discharging operation in which oil is discharged to the discharging orifice 313*a* from inside the movable body 38 are performed by the pistons 34 being slid reciprocally through the piston sliding apertures 321. When the pressure of the discharging passage 313 is lower than the allowable pressure, the movable body 38 is in a normal state covering the discharging orifice 313*a* due to the elastic force of recovery of the forcing spring 35.

Figure 2:
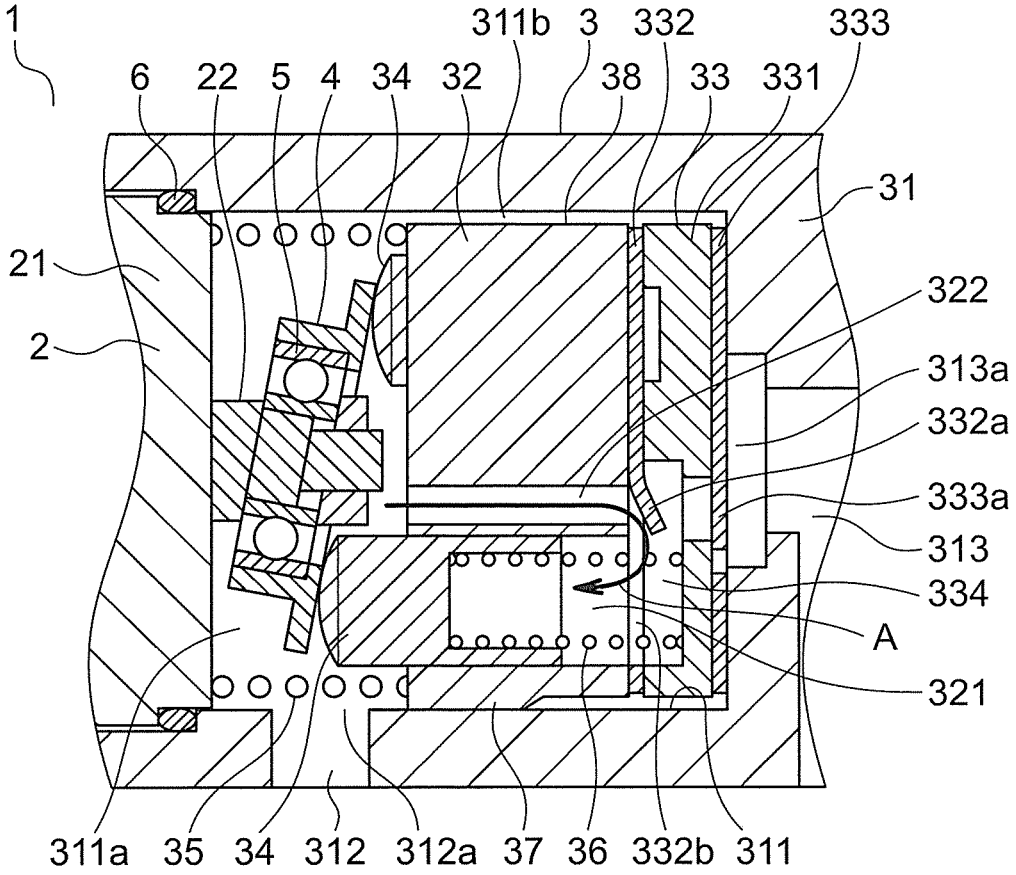
FIG. 2 is a cross section that shows a pump portion when performing a suction operation when a movable body from FIG. 1 is covering a discharging orifice.

FIG. 2 is a cross section that shows the pump portion 3 when performing the suction operation when the movable body 38 from FIG. 1 is covering the discharging orifice 313*a*. As shown in FIG. 2, space inside a piston sliding aperture 321 enlarges when the piston 34 moves away from the valve apparatus 33 (toward the motor portion 2). As the space inside the piston sliding aperture 321 enlarges, oil in the suction passage 312 is sucked inside the movable body 38 through the suction orifice 312*a*, the suction volume space 311*a*, and the respective suction aperture 322. At this point, the valve body 332*a* of the suction valve 332 deforms elastically in the direction in which the opening portion of the suction aperture 322 opens due to the suction pressure of the oil, and the oil is sucked from the suction aperture 322 through the pressurizing aperture 334 into the space inside the piston sliding aperture 321 as indicated by arrow A in FIG. 2. The suction operation of the pump portion 3 is performed in this manner.

Figure 3:
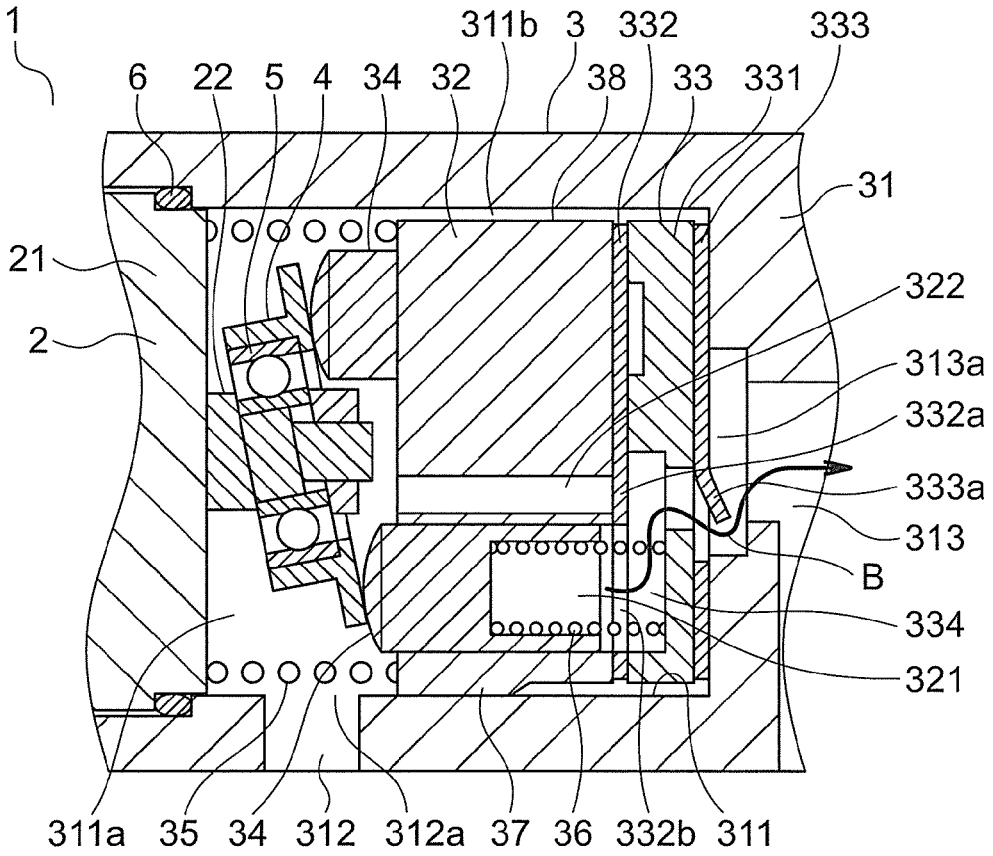
FIG. 3 is a cross section that shows the pump portion when performing a discharging operation when the movable body in FIG. 2 is covering the discharging orifice.

FIG. 3 is a cross section that shows the pump portion 3 when performing a discharging operation when the movable body 38 in FIG. 2 is covering the discharging orifice 313*a*. After the suction operation of the pump portion 3 is completed, the space inside the piston sliding aperture 321 is reduced as the pistons 34 moves toward the valve apparatus 33. As the space inside the piston sliding apertures 321 is reduced, the oil is pushed out of the space inside the piston sliding aperture 321. The valve body 333*a* of the discharging valve 333 thereby deforms elastically in the direction in which the opening portion of the pressurizing aperture 334 opens, and the oil is discharged from the pressurizing aperture 334 to the discharging orifice 313*a* and the discharging passage 313 as indicated by arrow B in FIG. 3. At this point, the flow of oil from inside the pressurizing aperture 334 to the suction aperture 322 is prevented by the valve body 332*a* of the suction valve 332. The discharging operation of the pump portion 3 is performed in this manner.

If the pressure in the discharging passage 313 exceeds the allowable pressure, then the state of the pump portion 3 enters a high-pressure state in which there is a risk that loads that act on the parts of the pump portion 3 may become excessive. At this point, a relieving operation that lowers the pressure of the discharging passage 313 in the pump portion 3 is performed.

Figure 4:
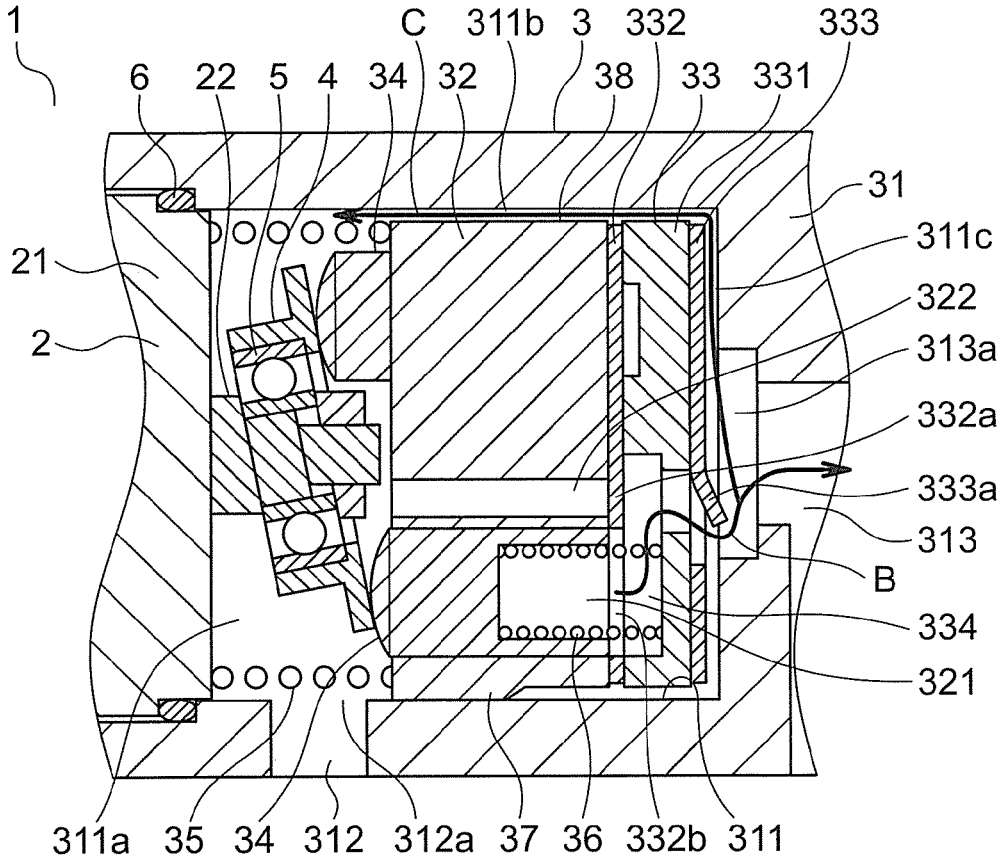
FIG. 4 is a cross section that shows a state in which the pump portion in FIG. 3 is performing a relieving operation.

FIG. 4 is a cross section that shows a state in which the pump portion 3 in FIG. 3 is performing a relieving operation. If the pressure in the discharging passage 313 exceeds the allowable pressure, then the force from the discharging orifice 313*a* that pushes the movable body 38 overcomes the elastic force of recovery of the forcing spring 35, and the movable body 38 is moved away from the discharging orifice 313*a* (toward the motor portion 2) in opposition to the elastic force of recovery of the forcing spring 35. At this point, the movable body 38 is guided by the guiding portions 37 while being moved. The movable body 38 is thereby separated from the bottom surface of the accommodating chamber 311, forming a relieving passage (a bypass passage) 311*c* between the bottom surface of the accommodating chamber 311 and the movable body 38. When the relieving passage 311*c* is formed, the suction volume space 311*a* and the discharging orifice 313*a* communicate with each other by means of the relieving passage 311*c* and the gap 311*b*, and at least a portion of the oil that is discharged from the movable body 38 is returned to the suction volume space 311*a* through the relieving passage 311*c* and the gap 311*b*, as indicated by arrow C in FIG. 4. The relieving operation of the pump portion 3 is performed in this manner. When the relieving operation of the pump portion 3 is performed, the pressure in the discharging passage 313 decreases, preventing the pressure in the discharging passage 313 from becoming too high. The dimensions of the gap 311*b* between the side surface of the accommodating chamber 311 and the outer circumferential portion of the movable body 38 are set to dimensions that are sufficiently large so as to prevent choking due to the flow of oil from the relieving passage 311*c* into the suction volume space 311*a* being constricted.

In an electric-powered pump 1 of this kind, because a relieving passage 311*c* that communicates between the suction volume space 311*a* and the discharging orifice 313*a* is formed between the bottom surface (an inner surface) of the accommodating chamber 311 and the movable body 38 by the movable body 38 that is accommodated inside the accommodating chamber 311 so as to cover the discharging orifice 313*a* moving away from the discharging orifice 313*a*, it is no longer necessary to install a pressure regulating apparatus for lowering the pressure in the discharging passage 31 on the pump portion 33 separately. Size reductions can thereby be achieved in the electric-powered pump 1. Furthermore, the installation of a pressure regulating apparatus that has a large number of parts can be avoided, enabling increases in the number of parts in the pump portion 3 to be suppressed. Thus, cost reductions for the electric-powered pump 1 can be achieved. In addition, increases in assembly man-hours for the pump portion 3 can also be suppressed, enabling the electric-powered pump 1 to be manufactured easily. In other words, component parts of the pump portion 3 can be protected from overloading while enabling size reductions, cost reductions, and facilitation of manufacturing of the pump portion 3.

Because the forcing spring 35 is disposed in the suction volume space 311*a* inside the accommodating chamber 311, it is no longer necessary to secure space for disposing the forcing spring 35 separately, enabling a pressure regulating function that adjusts the discharging pressure to be added to the pump portion 3 without changing the size of the pump portion 3. Enlargement of the pump portion 3 and bulky design modifications to the pump portion 3 due to addition of a pressure regulating function can thereby be avoided, enabling the pressure regulating function to be easily added to the pump portion 3. Consequently, reductions in the size and cost of a pump portion 3 to which a pressure regulating function is added are further enabled.

Because the guiding portions 37 that guide the movement of the movable body 38 are disposed on the side surfaces (inner surfaces) of the accommodating chamber 311 and on the movable body 38, the movable body 38 can be moved stably, enabling the discharging pressure of the pump portion 3 to be adjusted more reliably.

Because the flow of oil from the suction apertures 322 to the pressurizing apertures 334 and the flow of oil from the pressurizing apertures 334 to the discharging orifice 313*a* are allowed, and the flow of oil from the pressurizing apertures 334 to the suction apertures 322 and the flow of oil from the discharging orifice 313*a* to the pressurizing apertures 334 are prevented, by the valve plate 331, the suction valve 332, and the discharging valve 333 being stacked together in the valve apparatus 33, the configuration of the valve apparatus 33 can be simplified.

Embodiment 2

Figure 5:
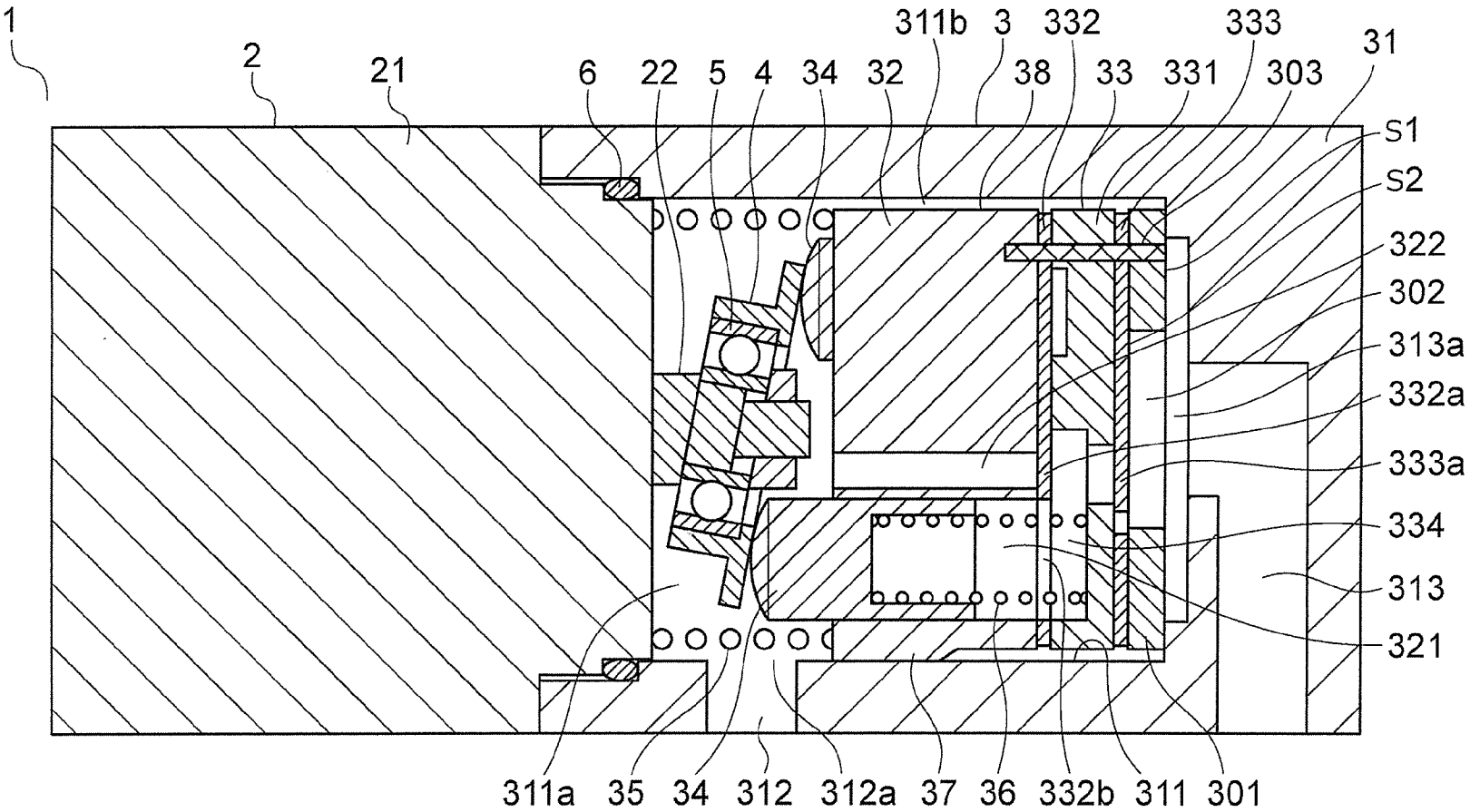
FIG. 5 is a cross section that shows an electric-powered pump according to Embodiment 2 of the present invention.

FIG. 5 is a cross section that shows an electric-powered pump according to Embodiment 2 of the present invention. A movable body 38 further includes: a fixing plate 301 that is stacked on a valve apparatus 33; and a rod-shaped interfitting pin 303 that is fixed to a fixing plate 301, that passes through a valve apparatus 33, and that is fitted into a cylinder 32. The fixing plate 301 and the interfitting pin 303 are movable through an accommodating chamber 311 together with the cylinder 32 and the valve apparatus 33. A gap 311*b* exists between the movable body 38, including the fixing plate 301, and a side surface of the accommodating chamber 311.

The fixing plate 301 is stacked on a discharging valve 333 so as to be disposed between the valve apparatus 33 and a discharging orifice 313*a*. A plate penetrating aperture 302 that passes through the fixing plate 301 is disposed on the fixing plate 301. The fixing plate 301 is stacked on the discharging valve 333 such that the positions of the valve bodies 333*a* of the discharging valve 333 are within a range of the plate penetrating aperture 302 when the valve apparatus 33 is viewed from the fixing plate 301.

The fixing plate 301 is in contact with a bottom surface of the accommodating chamber 311 when the movable body 38 covers the discharging orifice 313*a*. A seal is formed between the bottom surface of the accommodating chamber 311 and the fixing plate 301 by the fixing plate 301 coming into surface contact with the bottom surface of the accommodating chamber 311. Oil from the valve apparatus 33 is discharged to the discharging orifice 313*a* through the plate penetrating aperture 302 when the movable body 38 covers the discharging orifice 313*a*. An area S1 of a surface that is exposed on the discharging orifice 313*a* by the fixing plate 301 (a plate discharging pressure applying surface) is set so as to be greater than an area S2 of a surface that is exposed on the discharging orifice 313*a* by the discharging valve 333 (a valve discharging pressure applying surface).

Interfitting apertures into which the interfitting pin 303 fits are disposed on the valve plate 331, the suction valve 332, the discharging valve 333, and the cylinder 32, respectively. The interfitting pin 303 is inserted into each of the interfitting apertures sequentially in order of the discharging valve 333, the valve plate 331, the suction valve 332, and the cylinder 32. The valve plate 331, the suction valve 332, the discharging valve 333, and the cylinder 32 are thereby prevented from being dislodged from each other. The rest of the configuration is similar or identical to that of Embodiment 1.

Figure 6:
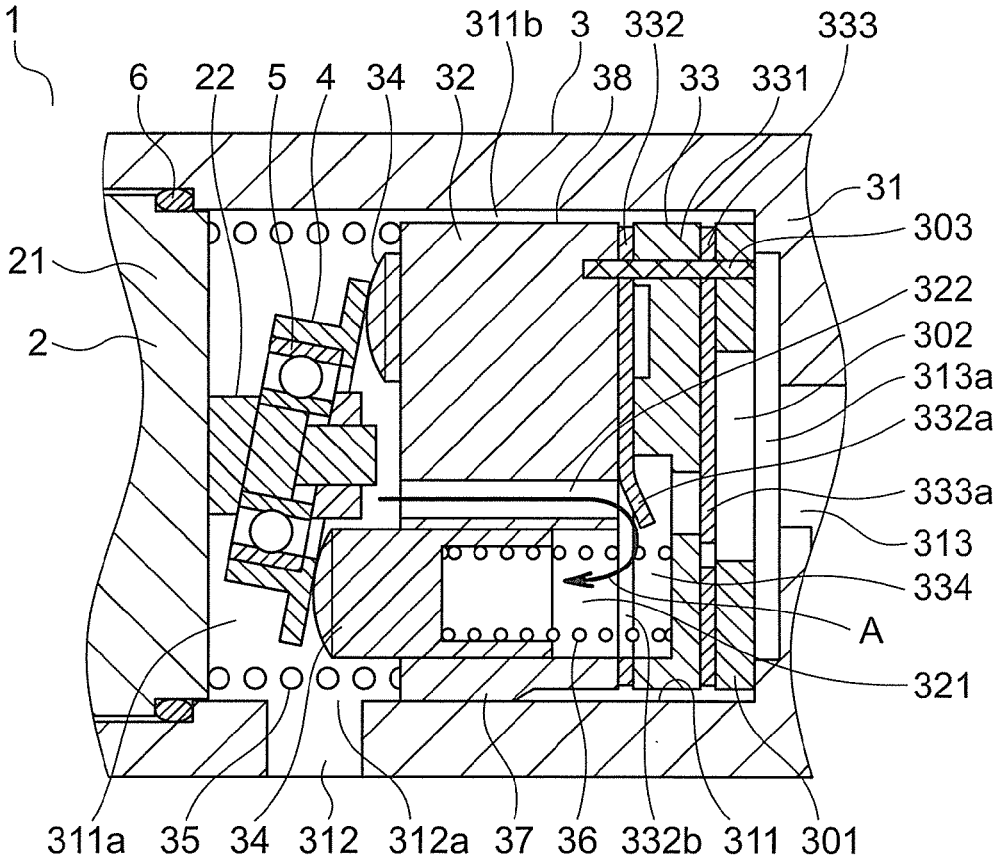
FIG. 6 is a cross section that shows a pump portion when performing a suction operation when a movable body from FIG. 5 is covering a discharging orifice.
Figure 7:
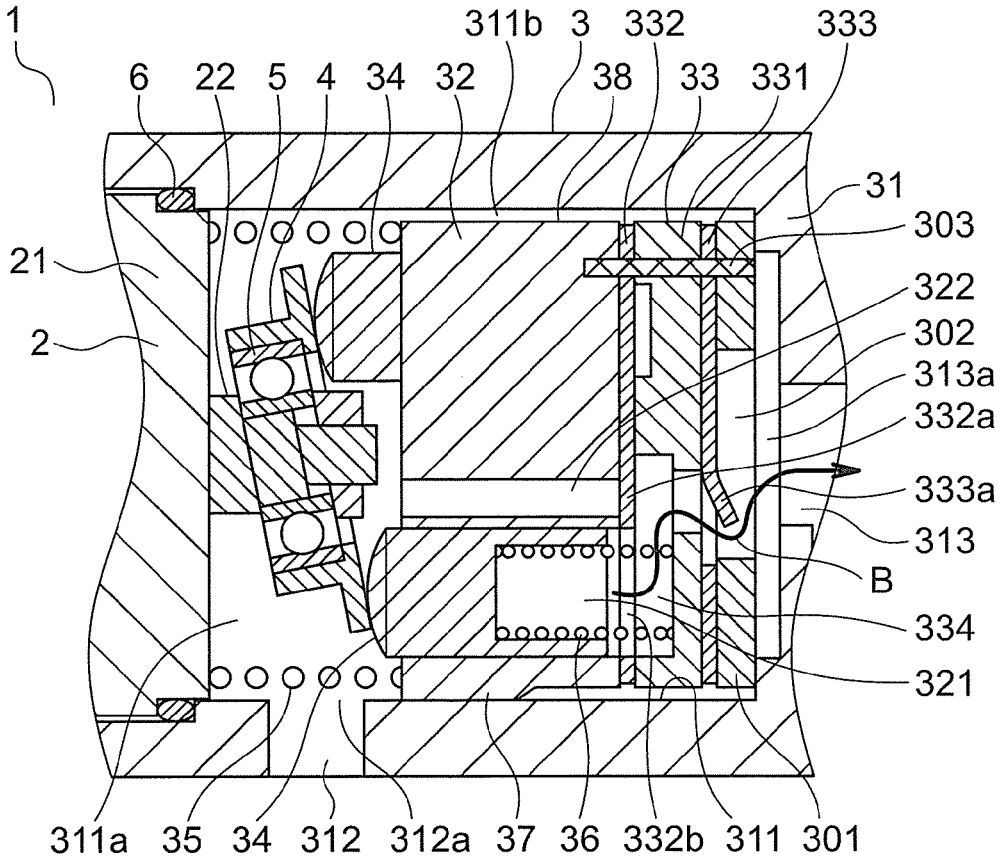
FIG. 7 is a cross section that shows the pump portion when performing a discharging operation when the movable body in FIG. 6 is covering the discharging orifice.

Next, operation of the electric-powered pump 1 will be explained. FIG. 6 is a cross section that shows a pump portion 3 when performing a suction operation when the movable body 38 from FIG. 5 is covering the discharging orifice 313*a*. FIG. 7 is a cross section that shows the pump portion 3 when performing a discharging operation when the movable body 38 in FIG. 6 is covering the discharging orifice 313*a*. The suction operation and the discharging operation of the pump portion 3 are performed in a similar or identical manner to those of Embodiment 1 by the pistons 34 being slid reciprocally through the piston sliding apertures 321 by the driving force from the motor portion 2, as shown in FIGS. 6 and 7.

If the pressure in the discharging passage 313 exceeds the allowable pressure, a relieving operation that lowers the pressure in the discharging passage 313 is performed by the pump portion 3.

Figure 8:
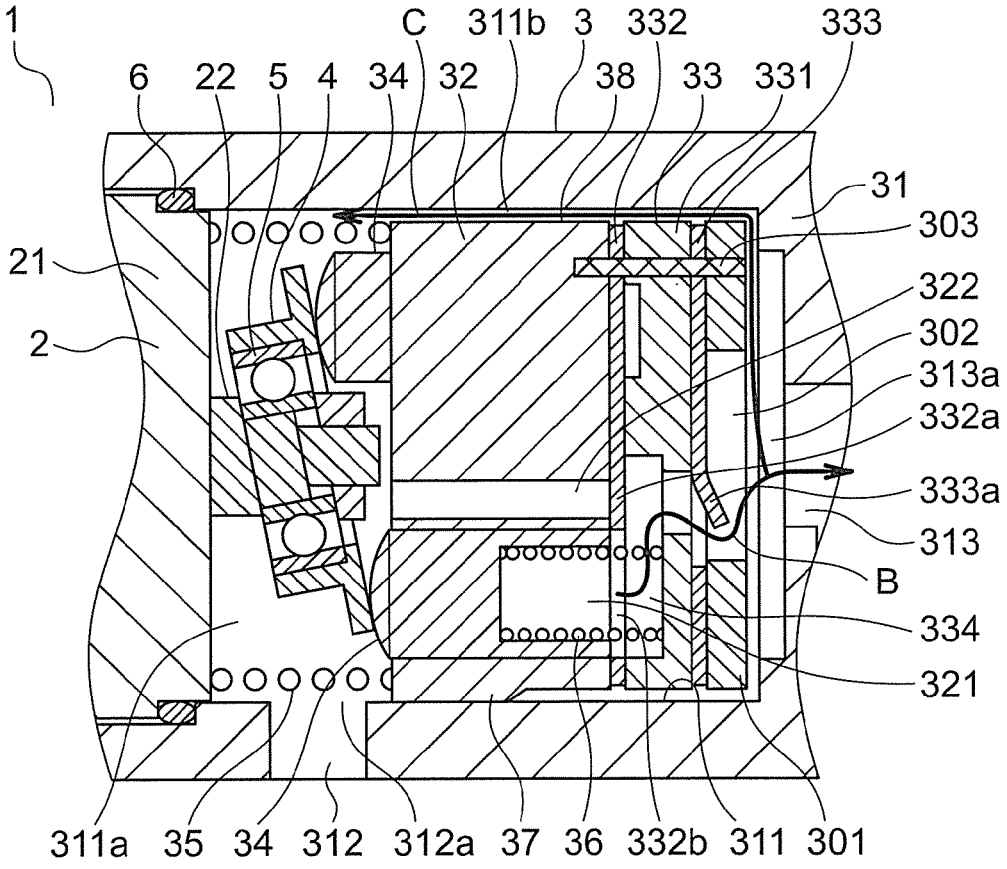
FIG. 8 is a cross section that shows a state in which the pump portion in FIG. 7 is performing a relieving operation.

FIG. 8 is a cross section that shows a state in which the pump portion 3 in FIG. 7 is performing a relieving operation. If the pressure of the discharging passage 313 exceeds the allowable pressure, then the movable body 38 is moved away from the discharging orifice 313*a* in opposition to the elastic force of recovery of the forcing spring 35, in a similar or identical manner to that of Embodiment 1. Here, the cylinder 32, the valve apparatus 33, the fixing plate 301, and the interfitting pin 303 are moved together with the movable body 38 because the cylinder 32, the valve apparatus 33, and the fixing plate 301 are held together by the interfitting pin 303. Here also, since the area S1 of the plate discharging pressure applying surface of the fixing plate 301 is greater than the area S2 of the valve discharging pressure applying surface of the discharging valve 333, the force that is pressed by the discharging pressure from the discharging orifice 313*a* is greater on the fixing plate 301 than on the valve apparatus 33, moving the fixing plate 301 and the valve apparatus 33 together.

When the movable body 38 moves in opposition to the elastic force of recovery of the forcing spring 35, the fixing plate 301 of the movable body 38 is separated from the bottom surface of the accommodating chamber 311, forming a relieving passage 311*c* between the bottom surface of the accommodating chamber 311 and the fixing plate 301. When the relieving passage 311*c* is formed, the suction volume space 311*a* and the discharging orifice 313*a* communicate with each other by means of the relieving passage 311*c* and the gap 311*b* in a similar or identical manner to that of Embodiment 1, and at least a portion of the oil that is discharged from the movable body 38 is returned to the suction volume space 311*a* through the relieving passage 311*c* and the gap 311*b*. The relieving operation of the pump portion 3 is performed in this manner.

In an electric-powered pump 1 of this kind, because the fixing plate 301, on which a plate penetrating aperture 302 is disposed, is disposed between the valve apparatus 33 and the discharging orifice 313*a*, and an interfitting pin 303 that passes through the valve apparatus 33 and that is fitted into the cylinder 32 is fixed to the fixing plate 301, integration of the cylinder 32, the valve apparatus 33, the fixing plate 301, and the interfitting pin 303 can be maintained more reliably. Thus, movement of the movable body 38 can be stabilized more reliably, enabling unstable behavior of the movable body 38 that arises when the flow rate of the oil that passes through the relieving passage 311*c* becomes excessive, or when a sudden change in oil flow rate occurs, for example, to be suppressed more reliably.

Embodiment 3

Figure 9:
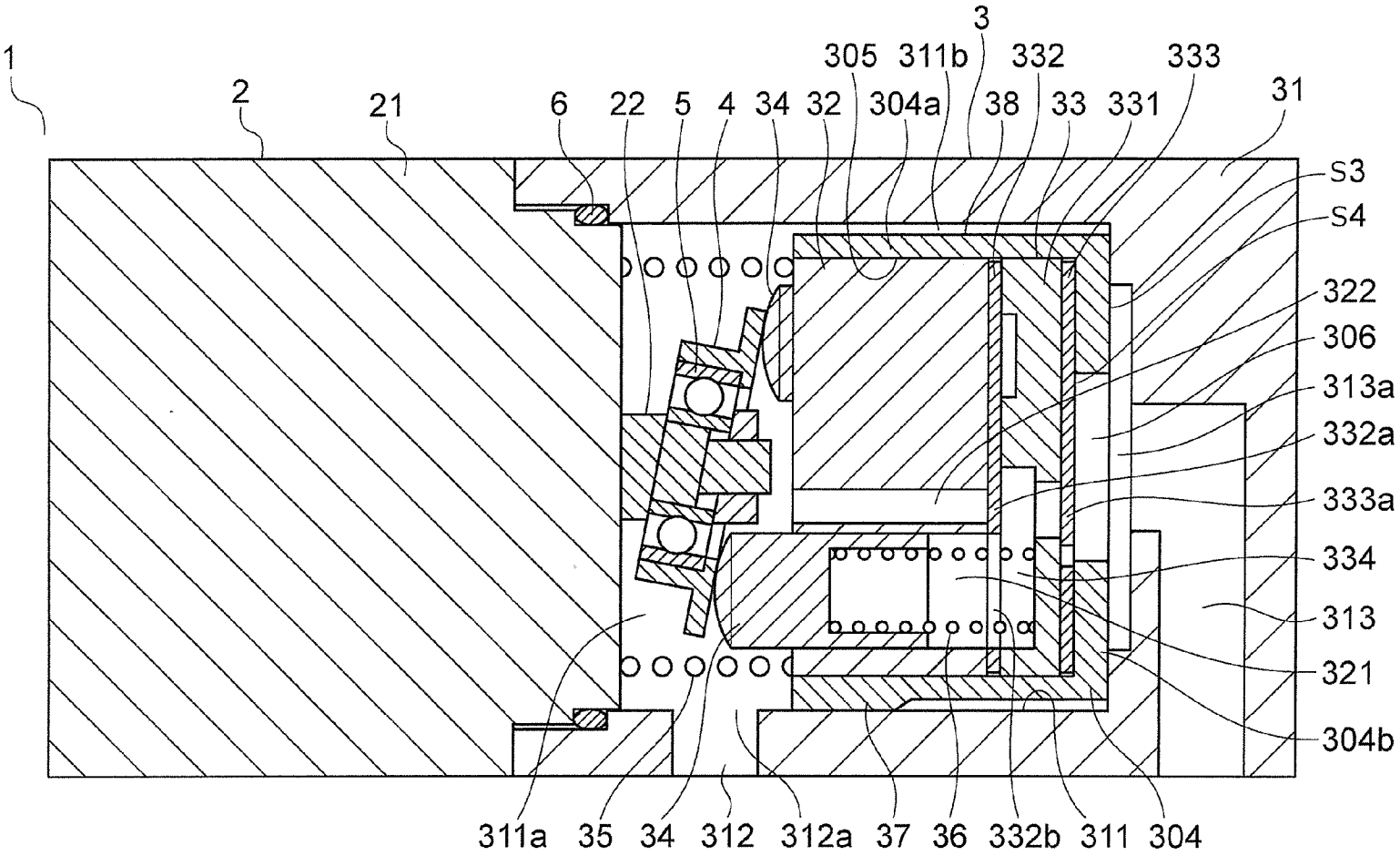
FIG. 9 is a cross section that shows an electric-powered pump according to Embodiment 3 of the present invention.

FIG. 9 is a cross section that shows an electric-powered pump according to Embodiment 3 of the present invention. A movable body 38 further includes a case 304 on which is disposed a recess portion 305 into which a cylinder 32 and a valve apparatus 33 are fitted together. The case 304 is movable through an accommodating chamber 311 together with the cylinder 32 and the valve apparatus 33.

The case 304 has: a cylindrical tubular portion 304*a* that surrounds outer circumferences of the cylinder 32 and the valve apparatus 33; and a bottom plate portion 304*b* that is fixed to an end portion of the tubular portion 304*a*, and that is disposed between the valve apparatus 33 and a discharging orifice 313*a*. The recess portion 305 is formed by the tubular portion 304*a* and the bottom plate portion 304*b*.

A case penetrating aperture 306 that passes through the bottom plate portion 304*b* is disposed on the bottom plate portion 304*b* of the case 304. An interior of the recess portion 305 and an exterior of the case 304 communicate with each other through the case penetrating aperture 306. The bottom plate portion 304*b* is stacked on a discharging valve 333 such that the positions of valve bodies 333*a* of the discharging valve 333 are within a range of the case penetrating aperture 306 when the valve apparatus 33 is viewed from the bottom plate portion 304*b*.

The bottom plate portion 304*b* of the case 304 is in contact with a bottom surface of the accommodating chamber 311 when the movable body 38 covers the discharging orifice 313*a*. A seal is formed between the bottom surface of the accommodating chamber 311 and the bottom plate portion 304*b* by the bottom plate portion 304*b* coming into surface contact with the bottom surface of the accommodating chamber 311. Oil from the valve apparatus 33 is discharged to the discharging orifice 313*a* through the case penetrating aperture 306 when the movable body 38 covers the discharging orifice 313*a*. An area S3 of a surface that is exposed on the discharging orifice 313*a* by the bottom plate portion 304*b* of the case 304 (a case discharging pressure applying surface) is set so as to be greater than an area S4 of a surface that is exposed on the discharging orifice 313*a* by the discharging valve 333 (a valve discharging pressure applying surface).

A gap 311*b* exists between an outer circumferential surface of the tubular portion 304*a* of the case 304 and a side surface of the accommodating chamber 311. A plurality of (in this example, three) guiding portions 37 that guide the movement of the movable body 38 in the accommodating chamber 311 are disposed on an outer circumferential surface of the tubular portion 304*a* and a side surface of the accommodating chamber 311. In this example, the guiding portions 37 are formed by fitting projections that are disposed on an outer circumferential portion of the tubular portion 304*a* of the case 304 into groove portions that are disposed on the side surface of the accommodating chamber 311. Furthermore, in this example, the guiding portions 37 are disposed on the tubular portion 304*a* so as to be uniformly spaced in a circumferential direction. Moreover, guiding portions are not disposed on the outer circumferential portion of the cylinder 32. The rest of the configuration is similar or identical to that of Embodiment 1.

Figure 10:
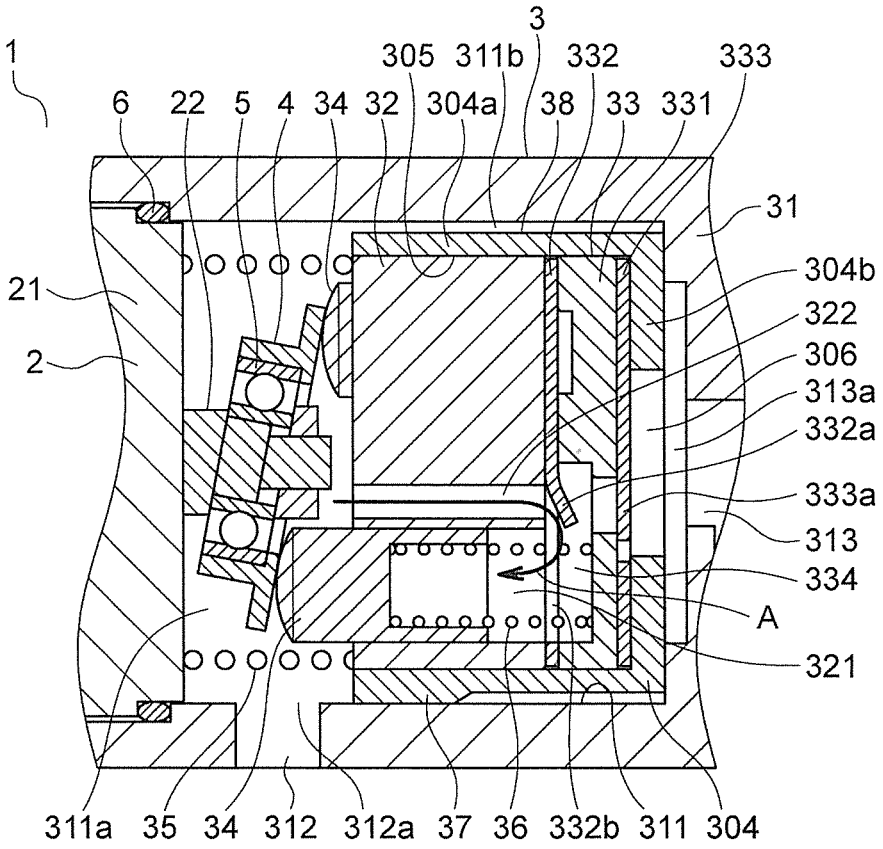
FIG. 10 is a cross section that shows a pump portion when performing a suction operation when a movable body from FIG. 9 is covering a discharging orifice.
Figure 11:
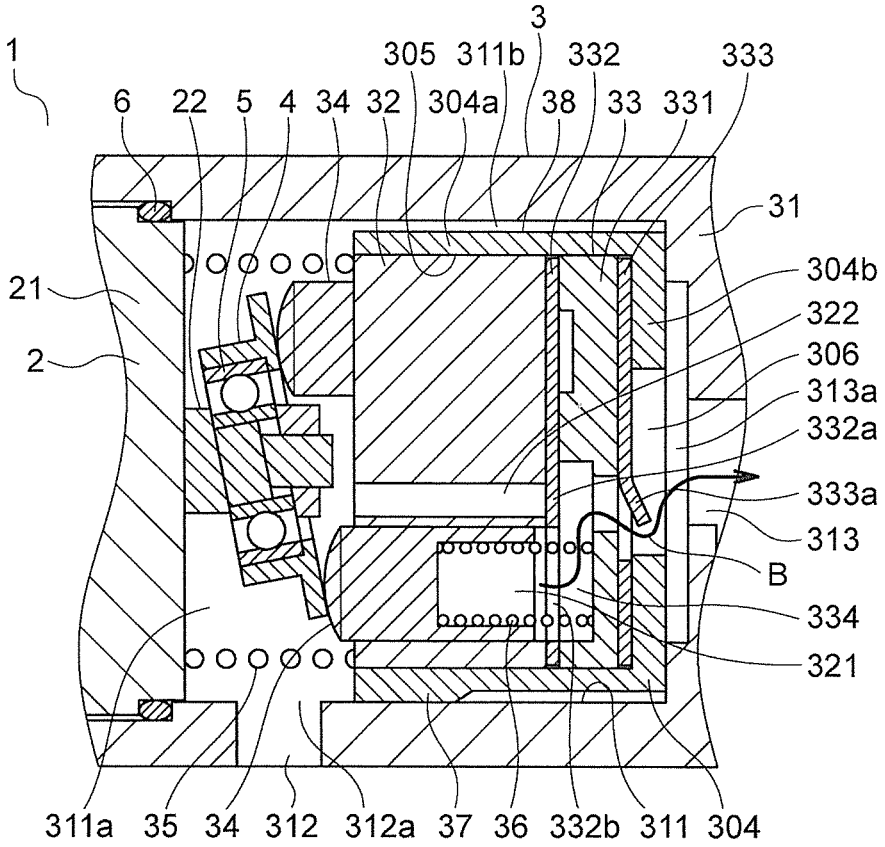
FIG. 11 is a cross section that shows the pump portion when performing a discharging operation when the movable body in FIG. 10 is covering the discharging orifice.

Next, operation of the electric-powered pump 1 will be explained. FIG. 10 is a cross section that shows a pump portion 3 when performing a suction operation when the movable body 38 from FIG. 9 is covering the discharging orifice 313*a*. FIG. 11 is a cross section that shows the pump portion 3 when performing a discharging operation when the movable body 38 in FIG. 10 is covering the discharging orifice 313*a*. The suction operation and the discharging operation of the pump portion 3 are performed in a similar or identical manner to those of Embodiment 1 by the pistons 34 being slid reciprocally through the piston sliding apertures 321 by the driving force from the motor portion 2, as shown in FIGS. 10 and 11.

If the pressure in the discharging passage 313 exceeds the allowable pressure, a relieving operation that lowers the pressure in the discharging passage 313 is performed by the pump portion 3.

Figure 12:
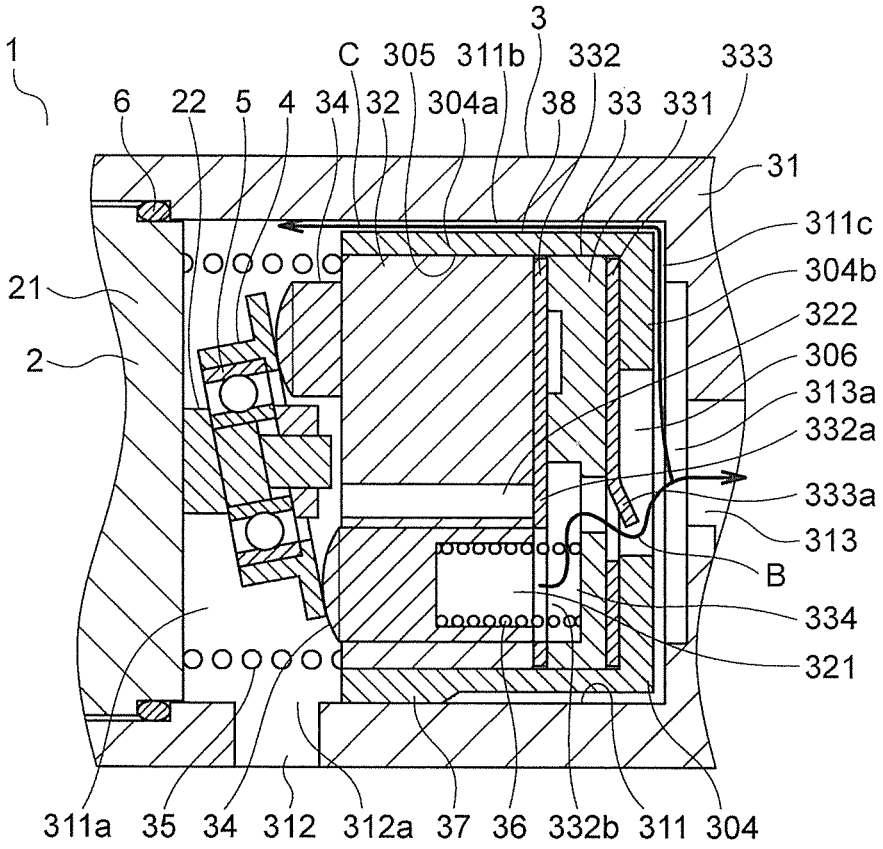
FIG. 12 is a cross section that shows a state in which the pump portion in FIG. 11 is performing a relieving operation.

FIG. 12 is a cross section that shows a state in which the pump portion 3 in FIG. 11 is performing a relieving operation. If the pressure of the discharging passage 313 exceeds the allowable pressure, then the movable body 38 is moved away from the discharging orifice 313*a* in opposition to the elastic force of recovery of the forcing spring 35, in a similar or identical manner to that of Embodiment 1. Here, the cylinder 32, the valve apparatus 33, and the case 304 are moved together with the movable body 38 because the cylinder 32 and the valve apparatus 33 are held together inside the case 304. Here also, since the area S3 of the case discharging pressure applying surface of the bottom plate portion 304*b* of the case 304 is greater than the area S4 of the valve discharging pressure applying surface of the discharging valve 333, the force that is pressed by the discharging pressure from the discharging orifice 313*a* is greater on the bottom plate portion 304*b* of the case 304 than on the valve apparatus 33, moving the case 304, the cylinder 32 and the valve apparatus 33 together.

When the movable body 38 moves in opposition to the elastic force of recovery of the forcing spring 35, the bottom plate portion 304*b* of the case 304 is separated from the bottom surface of the accommodating chamber 311, forming a relieving passage 311*c* between the bottom surface of the accommodating chamber 311 and the bottom plate portion 304*b* of the case 304. When the relieving passage 311*c* is formed, the suction volume space 311*a* and the discharging orifice 313*a* communicate with each other by means of the relieving passage 311*c* and the gap 311*b* in a similar or identical manner to that of Embodiment 1, and at least a portion of the oil that is discharged from the movable body 38 is returned to the suction volume space 311*a* through the relieving passage 311*c* and the gap 311*b*. The relieving operation of the pump portion 3 is performed in this manner.

In an electric-powered pump 1 of this kind, because the cylinder 32 and the valve apparatus 33 are fitted into the recess portion 305 of the case 304 together, integration of the cylinder 32, the valve apparatus 33, and the case 304 can be maintained more reliably without making significant modifications to the constructions of the cylinder 32 and the valve apparatus 33. Thus, movement of the movable body 38 can be stabilized more reliably and easily, enabling unstable behavior of the movable body 38 that arises when the flow rate of the oil that passes through the relieving passage 311*c* becomes excessive, or when a sudden change in oil flow rate occurs, for example, to be suppressed more reliably and easily.

Moreover, in each of the above embodiments, the present invention is applied to an automotive electric-powered oil pump, in which the fluid on which suction and discharging are performed is oil, but the present invention is not limited thereto, and may be applied to an electric-powered fuel pump in which the fluid on which suction and discharging are performed is fuel, for example.

The present invention is not limited to the above embodiments, and various changes can be made during implementation based on the basic technical concepts and teachings of the present invention.

EXPLANATION OF NUMBERING

1 ELECTRIC-POWERED PUMP; 2 MOTOR PORTION; 3 PUMP PORTION; 31 PUMP BODY; 32 CYLINDER; 33 VALVE APPARATUS; 34 PISTON; 35 FORCING SPRING (FORCING BODY); 37 GUIDING PORTION; 301 FIXING PLATE; 302 PLATE PENETRATING APERTURE; 303 INTERFITTING PIN; 304 CASE; 305 RECESS PORTION; 306 CASE PENETRATING APERTURE; 311 ACCOMMODATING CHAMBER; 311*a* SUCTION VOLUME SPACE; 311*c* RELIEVING PASSAGE; 312*a* SUCTION ORIFICE; 313*a* DISCHARGING ORIFICE; 321 PISTIN SLIDING APERTURE; 322 SUCTION APERTURE; 331 VALVE PLATE; 332 SUCTION VALVE; 333 DISCHARGING VALVE; 334 PRESSURIZING APERTURE (PRESSURIZING CHAMBER).

What is claimed is:

1. An electric-powered pump comprising:

a motor portion; and a pump portion that is operated by a driving force from the motor portion, wherein:

the pump portion includes:

a pump body in which an accommodating chamber is disposed, a suction orifice and a discharging orifice being formed on an inner surface of the accommodating chamber;

a movable body that includes:

a cylinder through which a piston sliding aperture passes; and a valve apparatus that is disposed on the cylinder, the movable body being accommodated inside the accommodating chamber so as to cover the discharging orifice such that the valve apparatus is disposed between the cylinder and the discharging orifice, and the movable body being movable inside the accommodating chamber away from the discharging orifice parallel to a direction of passage of the piston sliding aperture in the cylinder;

a piston that is inserted into the piston sliding aperture, and that sucks a fluid into the movable body through a suction aperture that passes through the cylinder and discharges the fluid from inside the movable body to the discharging orifice by being slid reciprocally through the piston sliding aperture by the driving force from the motor portion; and a forcing body that is disposed in a suction volume space that is a portion of a space inside the accommodating chamber that is on a side of the movable body that is near the suction orifice, the forcing body forcing the movable body in a direction in which the movable body covers the discharging orifice;

the valve apparatus allows flow of the fluid from the suction aperture to the discharging orifice, and also stops reverse flow of the fluid from the discharging orifice to the suction aperture; and a relieving passage that communicates between the suction volume space and the discharging orifice is formed between an inner surface of the accommodating chamber and the movable body by the movable body moving away from the discharging orifice in opposition to the force from the forcing body.

2. The electric-powered pump according to claim 1, wherein:

the movable body further comprises:

a fixing plate that is disposed between the valve apparatus and the discharging orifice, and on which a plate penetrating aperture is disposed; and an interfitting pin that is fixed to the fixing plate, that passes through the valve apparatus, and that is fitted into the cylinder; and the fluid from the valve apparatus passes through the plate penetrating aperture and is discharged to the discharging orifice when the movable body covers the discharging orifice.

3. The electric-powered pump according to claim 1, wherein:

the movable body further comprises a case on which is disposed a recess portion into which the cylinder and the valve apparatus are fitted together;

a case penetrating aperture that communicates an interior of the recess portion and an exterior of the case is disposed on the case; and the fluid from the valve apparatus passes through the case penetrating aperture and is discharged to the discharging orifice when the movable body covers the discharging orifice.

4. The electric-powered pump according to claim 1, wherein the valve apparatus comprises:

a valve plate that is disposed between the cylinder and the discharging orifice, and through which a pressurizing aperture passes;

a suction valve that is disposed between the cylinder and the valve plate, that allows flow of the fluid from the suction aperture to the pressurizing aperture and flow of the fluid between the pressurizing aperture and the piston sliding aperture, and that stops reverse flow of the fluid from the pressurizing aperture to the suction aperture; and a discharging valve that is disposed between the valve plate and the discharging orifice, that allows flow of the fluid from the pressurizing aperture to the discharging orifice, and that stops reverse flow of the fluid from the discharging orifice to the pressurizing aperture.

5. The electric-powered pump according to claim 1, wherein a guiding portion that guides movement of the movable body in the accommodating chamber is disposed on an inner surface of the accommodating chamber and on the movable body.

* * * * *